United States Patent [19]

Malinovitz

[11] 4,241,943

[45] Dec. 30, 1980

[54] PARKING CARD

[75] Inventor: Raphael Malinovitz, Granby, Conn.

[73] Assignee: Parking Control Systems, Granby, Conn.

[21] Appl. No.: 949,234

[22] Filed: Oct. 6, 1978

[51] Int. Cl.[3] ..... B42D 15/00

[52] U.S. Cl. ..... 283/13; 40/333; 283/8 A; 283/23; 283/6

[58] Field of Search ..... 283/9 R, 13, 48 R, 23, 283/66, 8 A, 6; 40/333

[56] References Cited

U.S. PATENT DOCUMENTS

| | | | |
|---|---|---|---|
| 513,151 | 1/1894 | Shattuc | 283/23 |
| 2,839,854 | 6/1958 | Martinet | 283/23 X |
| 2,961,777 | 11/1960 | Neville et al. | 283/9 R |
| 3,528,186 | 9/1970 | Roda | 283/23 X |
| 3,966,232 | 6/1976 | Doriel | 283/23 |
| 4,095,824 | 6/1978 | Bachman | 283/6 |

FOREIGN PATENT DOCUMENTS

| | | | |
|---|---|---|---|
| 2117793 | 10/1972 | Fed. Rep. of Germany | 283/6 |
| 1413918 | 9/1965 | France | 283/23 |
| 379818 | 8/1964 | Switzerland | 283/23 |
| 496386 | 11/1938 | United Kingdom | 283/66 R |

OTHER PUBLICATIONS

Oxydal Advertisement, May, 1965.

*Primary Examiner*—Paul A. Bell

*Attorney, Agent, or Firm*—Ostrolenk, Faber, Gerb & Soffen

[57] ABSTRACT

A parking card having month, day and expiration time indicia and adapted to be hung securely in a car window. Each of said indicia being coated with a friable removable coating of a different color from the underlying section. Each of said friable removable coatings being overprinted with indicia corresponding to the indicia of the underprinted sections. The friable removable coating over the expiration times being overprinted with starting times earlier than said expiration times.

11 Claims, 5 Drawing Figures

PARKING CARD

The present invention relates to parking cards more particularly to the type of parking card which is provided to automobile drivers who expect to park in a particular area which is restricted as to the length of time during which a car may be parked and which may not have meters.

Time restrictions in non-metered parking areas have been in use for many years. In most such areas the enforcement of the time restriction depends on a traffic officer or equivalent who makes some note either on a portion of the car or on a sheet carried by him with respect to cars that are parked and notes any violation for overtime parking. The advent of parking meters has changed this procedure since the violation notice on the parking meter, as is well known, will be sufficient to alert the traffic officer. One of the problems with a meter, however, is that, after a driver parks a vehicle for a short period of time and inserts the necessary coin, when he drives away another driver may park in the same area for the unexpired portion of the meter reading. Thus, there is no automatic wipe-out when the first car drives away and the second car parks without payment to the municipality. Also parking meters require substantial initial capital investment as well as maintenance and are subject to innocent damage and to vandalism.

As an alternate to the capital expense of meters, parking cards have come into use into some municipalities in which a card is sold with tear out or bend over portions. The driver, when he parks in a time restricted area, then will tear out or bend over the necessary tabs to indicate the date and the expiration time and will hang the parking card by a bend-over tab in, preferably, a side window closing the side window tightly. The bend over tab suspends the card from the top of the side window. The traffic enforcement officer may determine whether the car has been parked overtime. In the event that the tab or tear off portion is set for a much later expiration time than is proper for that particular parking card, then the driver runs the risk that the traffic enforcement officer will note the additional time thereby attempted to be obtained and may issue a violation notice.

One of the distinct advantages of such a parking card is that when the motorist drives away the space is no longer indicated as having been paid for and the next driver who occupies the space must use his own card.

One of the problems that has arisen with respect to such parking cards is that in the case of bent over time or date tabs, the tabs may be flattened out and the parking card reused. The traffic enforcement officer may possibly observe through the glass of the front side door that this has occurred but in general will be satisfied in passing by to notice that the appropriate tab has been torn out or bent over. In the case of tear out tabs or punch out holes it has been known for purchasers of the cards to scotch tape back the tear out or perforated portion in order to reuse the card.

The purpose is that the card must be so arranged that once a date and an expiration time has been indicated thereon, the card is not restorable by the user in any convenient manner short of spending a great deal more time and a great deal more money than the cost of a parking card.

The principal object of the present invention therefore is the provision of a parking card which when appropriately marked or used can no longer be restored to its original condition within any reasonable parameter of time and cost.

In order to obtain this result, the present invention contemplates the utilization of a parking card on which are printed the twelve months and 31 days as well as various expiration times. These printed indicia are covered over by a friable removable coating which itself may be printed with the same indicia but of a different color and size then the underlying printing; the time indicia is different, denoting various starting times for each expiration time. Such friable removable coatings are known and may be readily rubbed or scratched off with the fingernail or a coin without disturbing the underlying printed material. The overprint on the removable surface is primarily for information to the user. The underprint which shows expiration time is more prominent in size and color. Similarly, the underprint of the date indicia is more prominent from the removable overprint.

When the person using the park card parks in a one hour restricted space for which the parking card is provided, he will scratch off the friable removable coating over the month making the underprinted month appear in the space. He will also scratch off the friable removable coating for the date making the underprinted date appear. He will also scratch off the friable removable coating for any one of a series of starting periods as, for instance, 11:15 to 11:30 or 11:45 to 12:00, leaving an underprinted expiration time an hour after the last portion of the starting time. Other time intervals may be set by appropriate printing of the underprint.

The friable removable coating is of a different color, usually silver, than the underlying color of the card and the friable removable coating has printing on it which may be different in size and type face from the underlying printing. In order, therefor, for the parking card holder to attempt to reuse the card, he must not only recolor the portions which have been scraped off in the exact boundaries of the scraped off area and in the identical color or one which appears to be identical through the glass of the side door of the car, but he must also mark the recolored surface in such a way as to simulate the exact printing. Any variation in printing because of the adjacency must be of other printed areas will immediately be obvious and result not only in a parking violation charge but also a possible charge arising from the attempted cheating which charge may be much more serious. This will be enhanced if a confusion pattern is printed together with the initial indicia on the removable coating.

The foregoing and many other objects of the present invention will become apparent in the following description and drawings in which.

Figure 1:
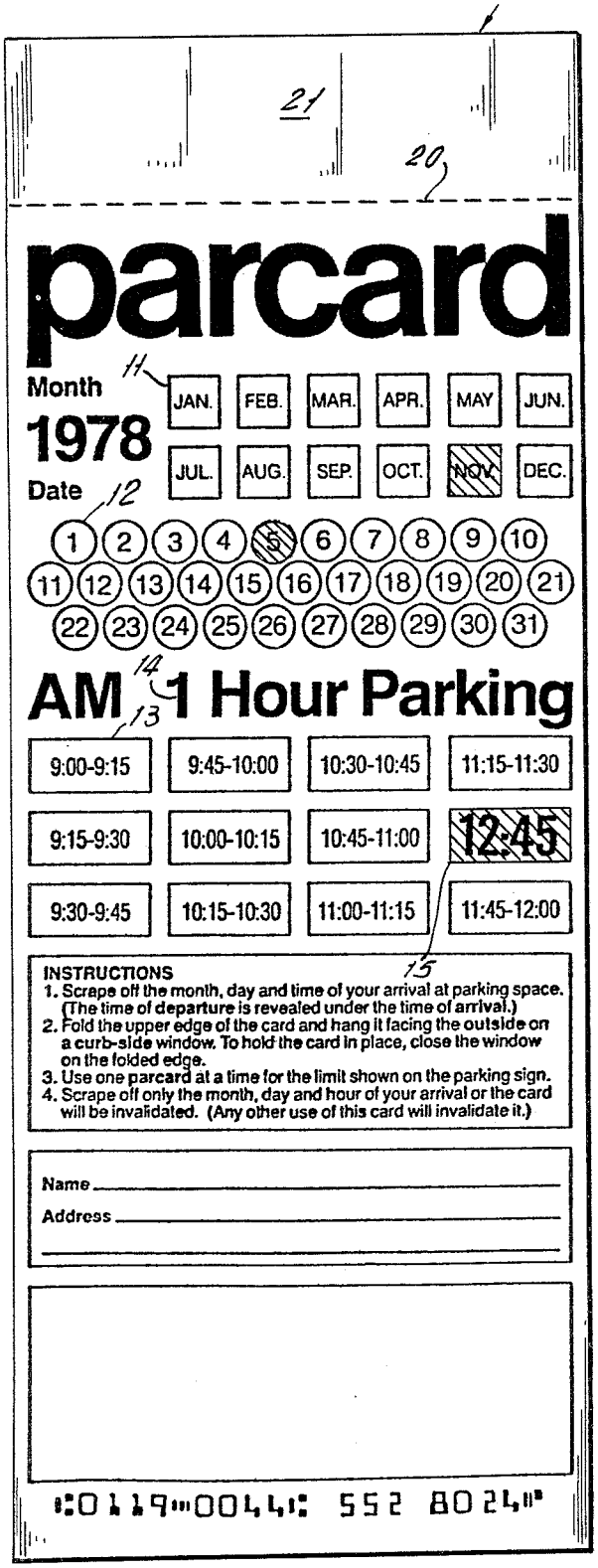
FIG. 1 is a view of the A.M. side of a two sided parking card.

Referring to FIG. 1, the A.M. face 10 of the parking card is provided with a series of month indicia 11, twelve such indicia being used for the twelve months of the year. A series of thirty one indicia, indicia 12 are used for the maximum number of days in any month. A series of indicia 13, in the original card before it is handled by the motorist, indicate starting times. Since the card at the portion 14 is marked as a one hour parking card, the motorist knows that the starting time of 9:00 to 9:15 will have an expiration time of 10:15 and the starting time 11:30 to 11:45 which has been erased on the card shown on the surface 10 of the card in FIG. 1 will have an expiration time as shown at 15 of 12:45 for a one hour parking card.

Figure 2:
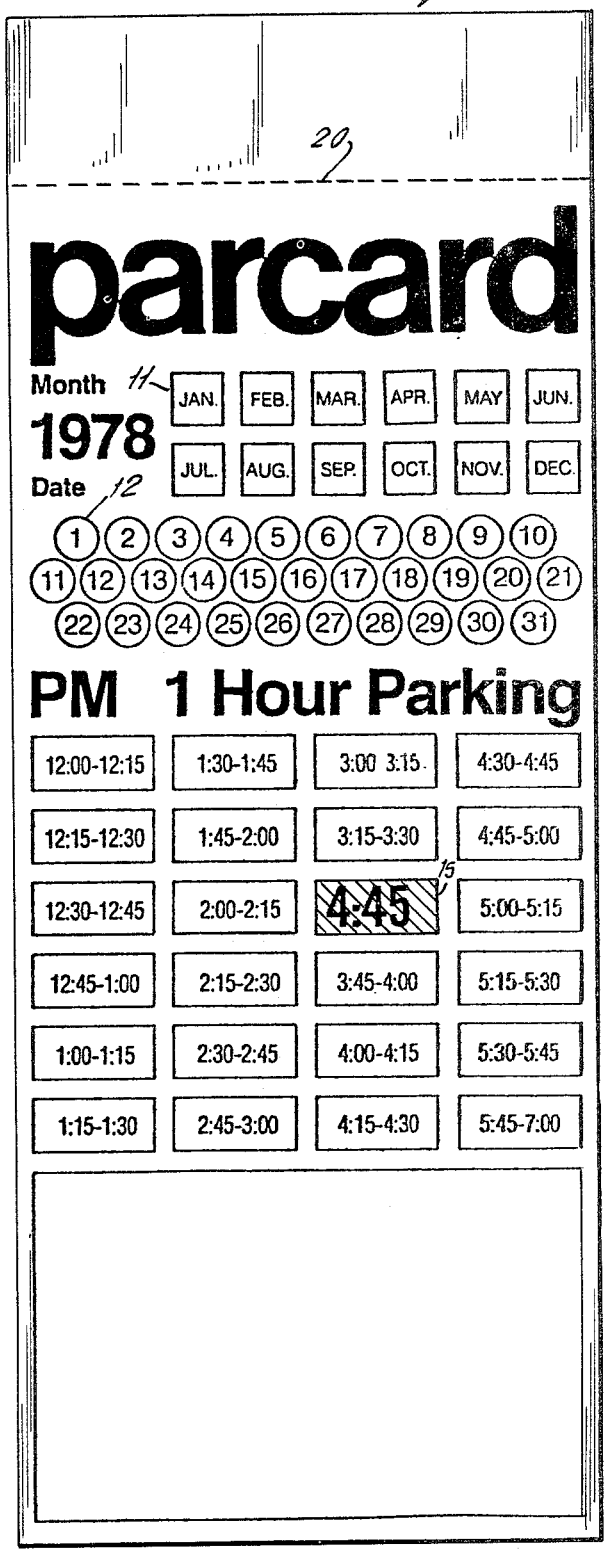
FIG. 2 is a view of the P.M. side of a two sided parking card.

The reverse of the card shown in FIG. 2 is printed for P.M. times and the same type of indicia are used therefore bearing the same reference numbers.

The base card is printed so that each of the months of the year is printed on the base card at the area 11. The thirty one days are printed on the base card at the area 12, and the series of expiration times are printed at the area 13, (in particular as seen in section 15 of the card in which the 11:30 to 11:45 portion has been removed).

Over the series of expiration times, only one of which is shown at the area 15, a friable removable material is coated. Such friable removable materials are now well known and have been used for instance in lottery cards in those states where lotteries are legal. The friable removable coating is of a color different from the background of the card on which the original printing has occurred, and is overprinted at section 11 with the successive months corresponding to the underlying months. The friable removable coatings for the thirty one days are overprinted with dates corresponding to the ones printed beneath and the friable removable coatings 13 are overprinted with starting times as shown at section 13, which when removed, will reveal as shown at section 15 an expiration time.

Thus, the user of the card, when he pulls into park alongside the curb or in a designated parking slot in a one hour restricted zone on November 5 at between 11:30 and 11:45 A.M. will scratch off with his fingernail or a coin the overcoated November indicia, the overcoated five indicia for the date and the overcoated 11:30 to 11:45 indicia at section 13 which is not shown. This will cause the expiration time 12:45 to appear at section 15.

He then folds the card along the fold line 20 to form the tab 21, places the printed surface of the card on which he made the various removals against the side window, folds the tab over the top of the window and closes the window tightly. Appropriate signs may indicate which window is to be used.

Now the traffic law enforcement agent, in passing by, will first see that there is at least a card present. Then the traffic law enforcement agent can very quickly observe the date and expiration time and thus is in a position to give notice of a violation, should one have occurred. Observance of the date and expiration time is facilitated by utilization of different forms to enclose the months, dates and times. That is the months are within small rectangles, the dates within circles and the times within large rectangles.

As far as the municipality is concerned, this is an improvement over parking meters; when the driver has driven away, there is no unexpired meter time which may be used free by the next driver, the next driver must himself provide the card.

The cards may be sold by the municipality in bulk at any locations of which local people are notified. Store keepers may be sold the cards at the same or a wholesale rate so that they may in turn resell the cards at the proper rate to customers who may come in to purchase the cards and then hang the appropriate card in the car window as above pointed out.

In any area where such cards are to be used, at least one store keeper in the block will in practice be provided with a prominent sign that he has a stock of such cards to sell. Cards may be given away by storekeepers seeking goodwill. Such cards may be used at any time during the entire year, but once a date and expiration time have been scratched off the card is no longer usuable.

Figure 3:
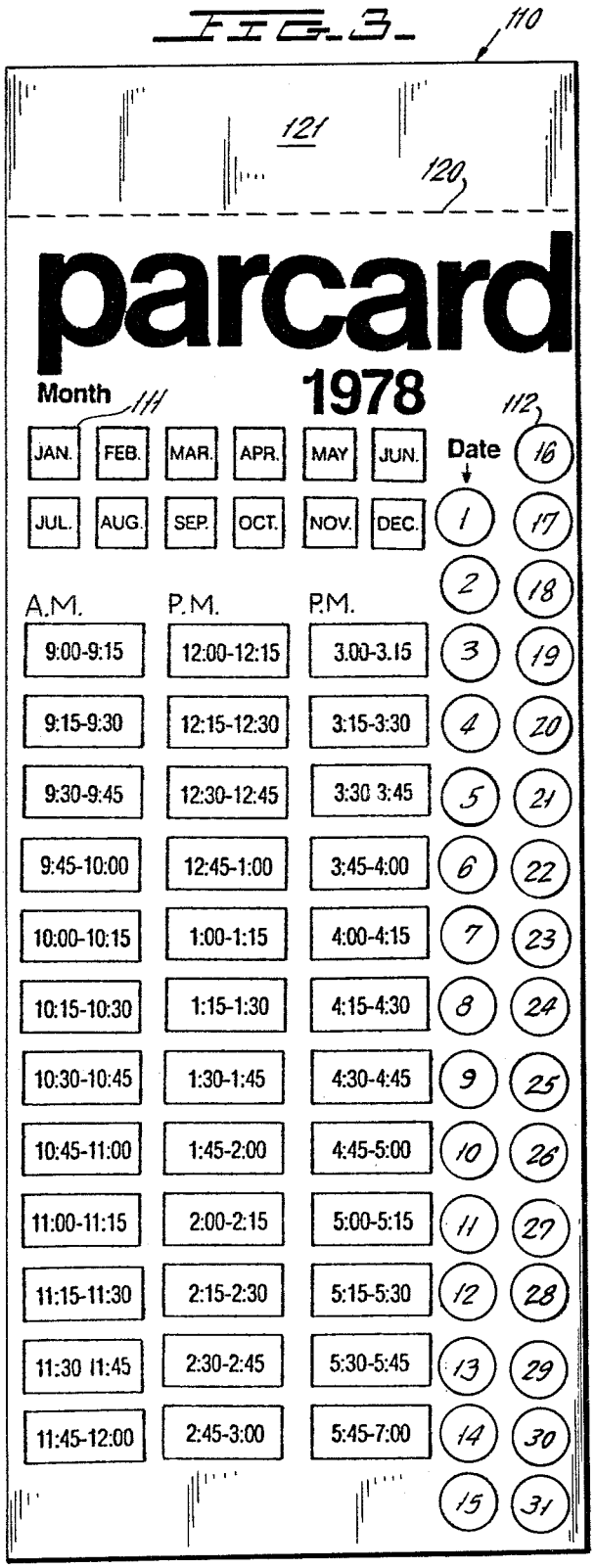
FIG. 3 is a view of a modified form of a one sided card in which one side of the parking card is used for both A.M. and P.M. and then the other side of the card is available for a second day or a second parking period or for advertising or instructional purposes.

It may be possible to print an instruction on the card that permits the utilization of two, three or more expiration times, but the card would have to be marked at the area 14 with a legend equivalent to the following "AM 1 hour parking-four times" or the AM may be removed and the card may be issued as shown in connection with FIG. 3 for an entire day on each side and the card may, of course, be issued with various parking times. Thus, a one hour parking time may cost 25 cents, a two hour parking time 30 cents and a 5 hour parking time 50 cents depending on the attitude of the municipality.

The officer reading the card having multiple indicia removed will check first whether the number of indicia removed is not more than the maximum and will then check the last date and time indication.

FIGS. 1 and 2 are similar because they show A.M. and P.M. sides of the same card so that the single card as shown without the particular legend may be above described but having the format exactly as shown in the drawings may be used twice, once on each side. This format permits the printing of very large expiration times.

In FIG. 3 a modified form is shown wherein all of the indicia for A.M. and P.M. are on a single side of a single card and in which the other side of the card may be used for the same purpose. Thus, the card will have at 111 the month indicia, at 112 the day of the month indicia and at 113 the starting time indicia. These indicia will be printed on the coated friable material which is coated within the outline of each of the underprinted areas and which are then overprinted at 111 again with the month indicia at 112 and with the date indicia; but at 113 with starting time indicia. The cards may be sold as above pointed out for various lengths of parking time. The card of FIG. 3 is provided with the bend line 120 and the tab 121 as is the card of FIGS. 1 and 2.

Figure 4:
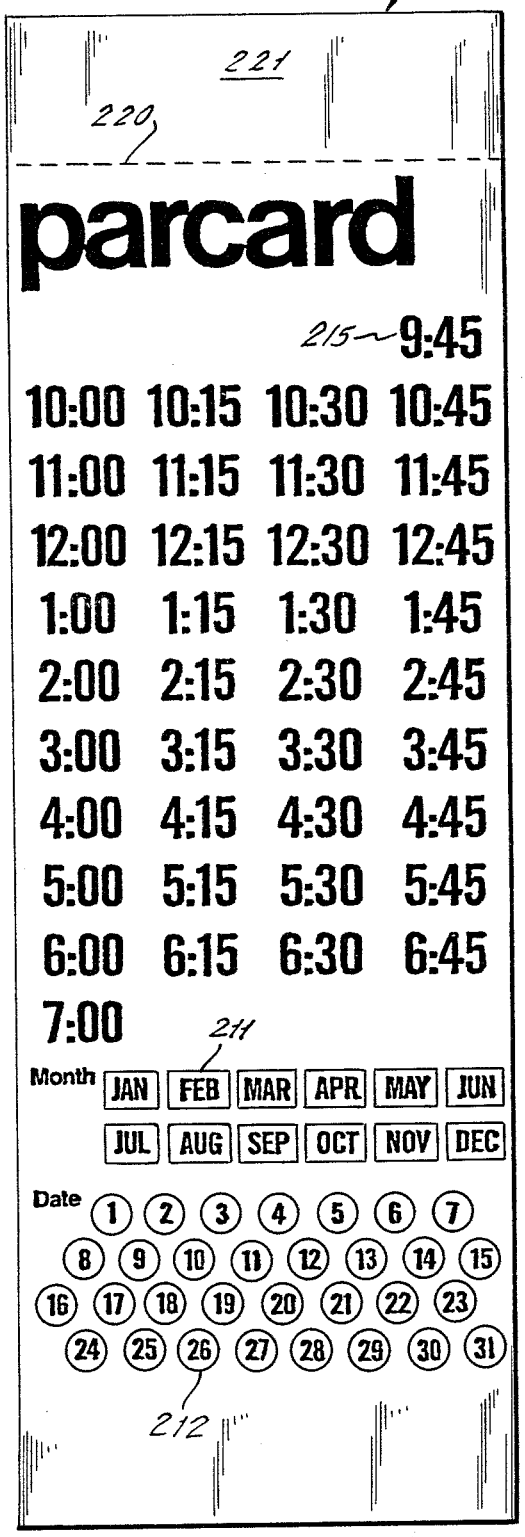
FIG. 4 is a view of another modified form of parking card showing the underprinted area thereof before a coating has been applied.
Figure 5:
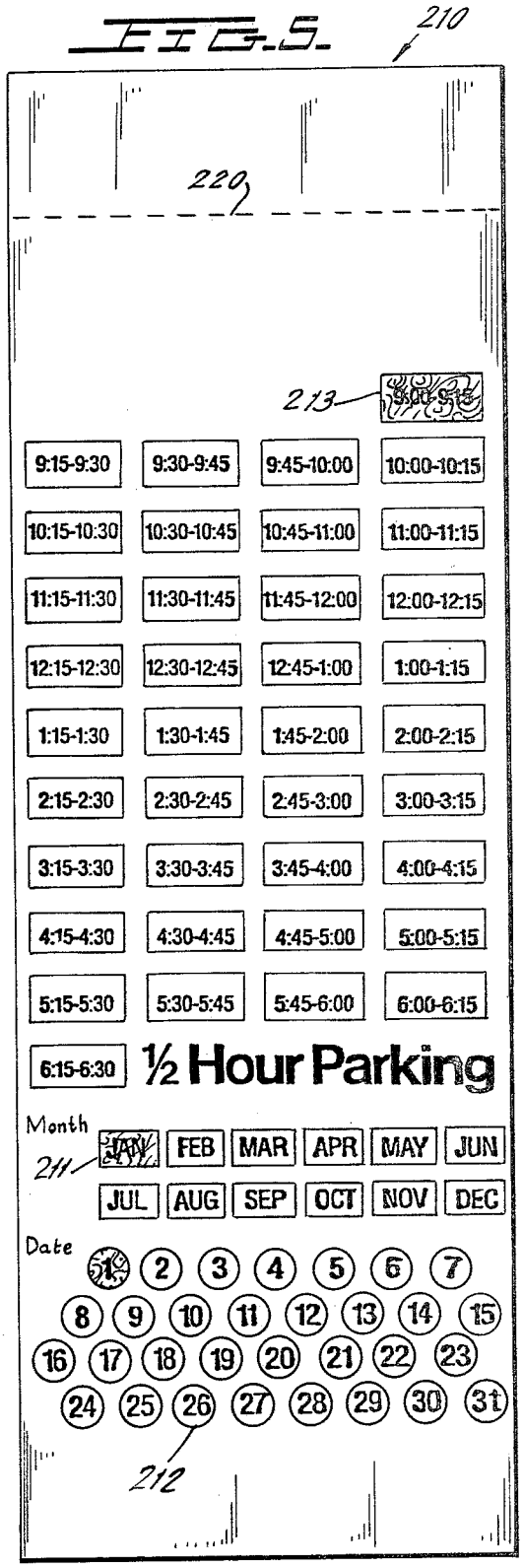
FIG. 5 is a view of the card of FIG. 4 with the overprinted removable coating placed thereon and overprinted.

FIGS. 4 and 5 show a further alternative form of parking card in which the elements have been given reference numbers similar to those in FIGS. 1, 2 and 3 except that each of the reference numbers is preceded by a 2 and the reference numbers are then in the 200 series. In this case, however, the removable coating, rather than merely covering the areas within the rectangles and circles, is an all over coating which is baked on or otherwise applied to the base card during the underprinting shown in FIG. 4. This starting time indicia 213 are outlined with individual rectangles. This particular type of coating, particularly the all over coating, lends itself better to the utilization of a confusion pattern printed thereon so that any attempt to replace a removed portion will not only require color matching and matching of the print of the numerical indicia but also a matching of the confusion pattern. The essential element is that the coating which is applied be removable by scratching with a coin or fingernail and thus be removable only at the area where such indicia are to be removed by a simplified process which, as a practical matter, cannot be reversed.

By this means, therefore, instead of a card with bent down or tear off portions or punch out portions which may be replaced with some facility, a card is provided which is guaranteed to have a one time use only or, at a maximum, the number of uses prominently printed on the card. The friable material once removed cannot be replaced.

The underprinted portion is preferably printed in bright highly visible colors. The color rectangles may be printed first; then the indicia may be printed thereon. The removable coating is then placed thereon. A confusion pattern in a series of rectangles is printed on the removable coating in a color which contrasts with the underprinted color. Then the starting times are printed on the patterned rectangles. Not only may the basic color portions contrast with the removable portion, but also the basic color rectangles for the expiration times, dates and months may contrast with adjacent rectangles to facilitate observance by the officer.

Any given hours may be a single base color for the horizontal segments within that hour. The segments of hours are vertically aligned. Thus, the problem of cheating is diminished because of the gross amount of time and effort required to attempt to restore the card to its original condition. It would not only be necessary to match the color of the removable friable coating but also to overprint or overmark the restored color portion in a manner to match the other printing. The combination of the false color match and the necessary difference in printing may be overcome with a great deal of care and a great deal of time which considering the amount of money involved simply will not pay. The fact that the unremoved portions of the friable coating are adjacent to the removed portion means that an attempt to restore the card will provide an immediate reference with respect to matching and an attempt to overprint the restoration will provide an immediate reference with respect to the remaining printed portions overprinted on the removable friable coating.

In addition, on the base card a colored stripe may be printed across each set of horizontal indicia different from the colored stripe on the adjacent horizontal set of indicia so that an enforcement officer passing by may quickly tell from the color that the exposed expiration date is in the desired range or is outside of the desired range. If desired the colored stripes may be arranged vertically for the same purpose. In every case the base printing of month, date and expiration time should be in contrast to the printing on the coating.

As an alternative to having fold-over securing tab 21, a strip of pressure activated adhesive may be provided for holding the parking card in viewable position.

To reduce the probability of littering, each parking card will be given a different serial number and thereby serve as a ticket for a lottery conducted by the parking authorities. Instead of utilizing numbered cards for the lottery, each card may have a form portion to be completed by inserting a name and address. These latter cards may be mailed to the parking authorities to be used as cards for a drawing or lottery. Where serial numbers are used, a traffic enforcement officer will be required to use this number on summonses for overtime parking violations. If the alleged violation did not take place, merely producing the card in question should prove conclusively that the alleged violation had not, in fact, taken place.

In the foregoing the present invention has been described solely in connection with preferred illustrated embodiments thereof. Since many variations and modifications of the present invention will now be obvious to those skilled in the art, it is preferred that the scope of this invention be determined not by the specific disclosure herein contained but only by the appended claims.

What is claimed is:

1. A parking card comprising a base surface area having a plurality of printed sections, one of said sections having a series of numbers corresponding to the maximum number of dates in a month and a second of said sections being printed with a series of spaced time indications indicating successive expiration times;

a friable removable coating placed over each of the date indicators and a friable removable coating placed over each of the expiration time indicators;

the removable coating over each date indicator being overprinted with dates corresponding to the dates beneath;

and the removable coating over the expiration time indicators being overprinted with a series of successive starting times at a selected time interval before the underprinted expiration time;

the removable coating being readily removable by the user to indicate a desired date and an actual parking time and an actual starting time;

such removable coating, when removed, revealing the underlying date and the underlying expiration time respectively.

2. The parking card of claim 1 in which said plurality of sections also includes a plurality of month indicia each printed with successive months and each having a friable removable coating thereon; each of the coatings being overprinted with the month corresponding to the underlying month.

3. The parking card of claim 2 wherein each of the indicia on the removable coating is colored differently from the color of the underlying printed indicia.

4. The parking card of claim 3 having an extending tab from one end thereof which tab may be folded over the top of a car door window and secured by said window when closed.

5. The parking card of claim 3 wherein the coating is a removable coating having the characteristic of turning to a powder when scratched over a selected area.

6. The parking card of claim 3 wherein the coating in addition to carrying the indicia carries a printed confusion pattern.

7. The parking card of claim 6 wherein the base surface indicia are colored similarly across a series of indicia.

8. The parking card of claim 6 wherein the base surface is provided with vertically aligned printed sections of different colors.

9. The parking card of claims 3 or 6 in which the base card is printed in a plurality of colors with each of said colors identifying a predetermined group of selected time expiration indicia.

10. The parking card of claim 6 wherein the base card is printed on both sides and coated on both sides.

11. The parking card of claim 9 wherein the base card is printed on both sides and coated on both sides.

* * * * *